US007145082B2

(12) United States Patent
Hochleithner et al.

(10) Patent No.: US 7,145,082 B2
(45) Date of Patent: Dec. 5, 2006

(54) FLEXIBLE ELECTRICAL LINE

(75) Inventors: Thomas Hochleithner, Leopoldsdorf (AT); Thomas Noetzel, Floss (DE)

(73) Assignee: Nexons, Paris (FR)

( * ) Notice: Subject to any disclaimer, the term of this patent is extended or adjusted under 35 U.S.C. 154(b) by 0 days.

(21) Appl. No.: 10/494,679

(22) PCT Filed: Nov. 15, 2002

(86) PCT No.: PCT/EP02/12796

§ 371 (c)(1),
(2), (4) Date: Jul. 22, 2004

(87) PCT Pub. No.: WO03/043030

PCT Pub. Date: May 22, 2003

(65) Prior Publication Data

US 2005/0000724 A1 Jan. 6, 2005

(30) Foreign Application Priority Data

Nov. 16, 2001 (DE) ..... 201 18 713

(51) Int. Cl.
*H01B 7/00* (2006.01)

(52) U.S. Cl. ..... 174/113 C; 174/128.1

(58) Field of Classification Search ..... 174/113 C, 174/131 A, 128.1, 128.2
See application file for complete search history.

(56) References Cited

U.S. PATENT DOCUMENTS 3,980,808 A * 9/1976 Kikuchi et al. ..... 174/110 SR
4,022,010 A * 5/1977 Gladenbeck et al. ..... 57/231
4,034,547 A * 7/1977 Loos ..... 57/211
4,449,012 A * 5/1984 Voser ..... 174/70 A
4,820,012 A * 4/1989 Asai ..... 385/101
4,861,947 A 8/1989 Altermatt et al. ..... 174/113
5,113,039 A 5/1992 Guipe et al. ..... 174/113
5,159,157 A * 10/1992 Diegmann ..... 174/113 C
5,216,205 A * 6/1993 Fujii et al. ..... 174/128.1
6,563,054 B1 * 5/2003 Damien et al. ..... 174/120 C
6,576,844 B1 * 6/2003 Kamata ..... 174/126.1

FOREIGN PATENT DOCUMENTS

| | | | |
|---|---|---|---|
| EP | 0477982 | | 4/1992 |
| WO | WO 94/06126 | * | 3/1994 |
| WO | WO 00/17441 | * | 3/2000 |

OTHER PUBLICATIONS

International Search Report dated Mar. 5, 2003.
Preliminary Examination Report with translation dated May 7, 2004 for PCT/EP02/12796.

* cited by examiner

*Primary Examiner*—Chau N. Nguyen
(74) *Attorney, Agent, or Firm*—Sofer & Haran, LLP

(57) ABSTRACT

A flexible electric line with at least one electrical conductor is provided having a high tensile, nonmetallic element and a plurality of highly conductive metal wires arranged around it. The flexible electric line has a high tensile element that is a loose composite of a large number of aramid fibers, the cross section of this element being the same as that of one of the individual metallic wires and where the conductor is surrounded by a layer of insulation.

5 Claims, 1 Drawing Sheet

FLEXIBLE ELECTRICAL LINE

RELATED APPLICATION

This application is a National Stage application of PCT Patent Application No. PCT/EP02/12796, filed on Nov. 15, 2002, which in turn claims the benefit of priority from German Patent Application No. 201 18 713.2, filed on Nov. 16, 2001, the entirety of which are incorporated herein by reference.

BACKGROUND OF THE INVENTION

The invention pertains to a flexible electric line with at least one electrical conductor, which consists of a nonmetallic element of high tensile strength and a plurality of highly conductive metal wires arranged around it (DE-OS 25 19 687).

FILED OF THE INVENTION

Lines of this type are used, for example, in motor vehicles. They must be very flexible and have high tensile strength, and they must also be able to withstand high mechanical loads. This is especially true, of course, when the vehicle is in operation, but they must also be able to withstand severe loads during the time that they are being fabricated, subjected to further processing, and installed. These lines are also exposed to continuous vibrations in the vehicle and also to impacts from stones.

EP 1 089 299 A2 discloses a high tensile conductor, in which several wires of highly conductive material are wrapped around a central, high tensile wire. A common layer of insulation is provided around the highly conductive wires. The high tensile wire consists of several high tensile fibers of suitable material twisted together, which are embedded in a metallic base material. The base material fills all of the free spaces between the fibers and surrounds them overall. A high tensile wire of this type is not only expensive to produce but also relatively stiff and is not resilient in the radial direction. This causes problems when contact elements are supposed to be crimped onto a conductor made in this way. A conductor of this type is also limited with respect to flexibility, and it has a reduced level of reversed bending strength.

The previously mentioned DE-OS 25 19 687 describes a line in which a large number of copper wires is arranged around a fiber of fibrous glass ply yarn. A fiber of this type is still relatively stiff as a result of its twist, nor is it resilient in the radial direction. The same problems as those of the conductor according to EP 1 089 299 A2 are therefore encountered again.

OBJECTS AND SUMMARY OF THE INVENTION

The invention is based on the task of designing the previously described line in such a way that it satisfies all requirements with respect to flexibility, tensile strength, contactability, and reversed bending strength without limitation.

This task is accomplished according to the invention in that:

the high tensile element is a loose composite of a large number of aramid fibers, the cross section of this element being the same as that of one of the individual metallic wires; and in that the conductor is surrounded by a layer of insulation.

This is a highly flexible, high tensile line. It is also characterized by extremely high reversed bending strength, because its high tensile element is very easily deformable in the radial direction and is also highly flexible overall. The high tensile element thus does not prevent the conductor from being deformed as required when contact parts are to be attached by crimping. In a crimped connection, the individual wires of the conductor are intended to be deformed in a honeycomb-like manner. The line, i.e., its conductor, thus satisfies all of the specifications which exist for a permanent and effective crimp connection. In spite of this, the tensile strength required during manufacture and installation of the line is also ensured. Because the element consisting of the aramid fibers absorbs all of the tensile loading which occurs, the conducting cross section of each conductor, consisting of a plurality of wires, can be reduced to the minimum electrical value required. This advantageous design of the conductor functions over a wide temperature range from about +160° C. to −70° C. Because aramid neither melts nor promotes combustion, brief periods of high temperatures of more than 300° C. have hardly any negative effect. The line can be used to particular advantage in cases where it is exposed continuously to severe vibrations, such as in automotive applications.

BRIEF DESCRIPTION OF THE DRAWINGS

An exemplary embodiment of the invention is illustrated in the drawings.

DETAILED DESCRIPTION

Figure 1:
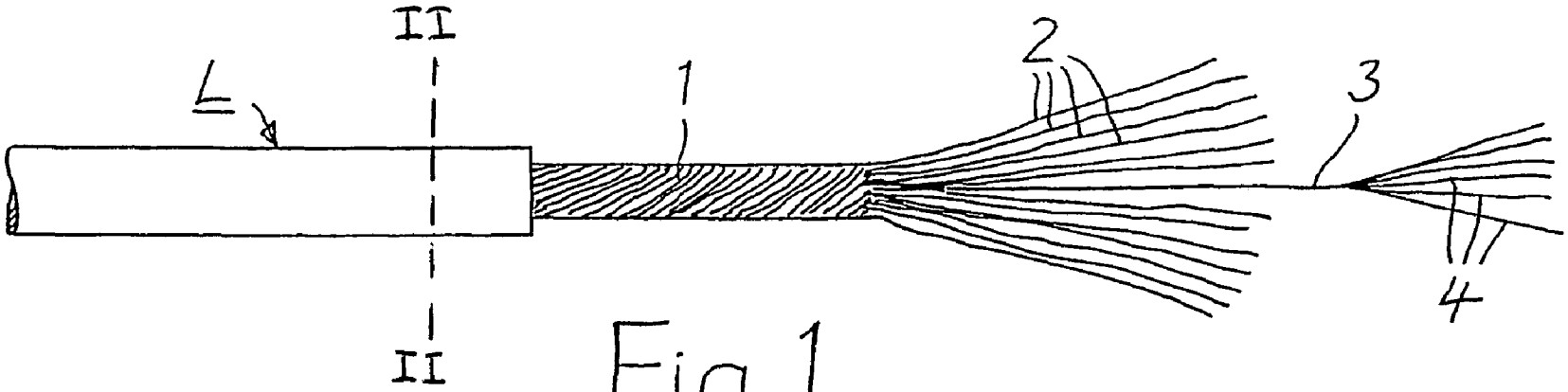
FIG. 1 shows a side view of a line according to the invention consisting of an insulated conductor.
Figure 2:
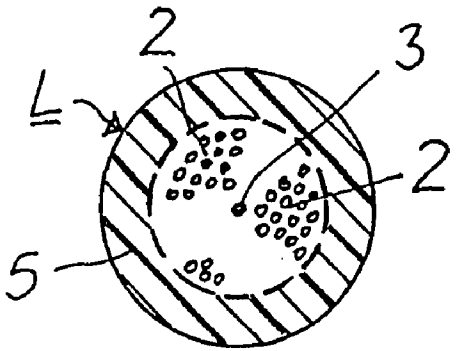
FIG. 2 shows an enlarged cross section through the line of FIG. 1 along line II—II.

The electric line L according to FIGS. 1 and 2 has a conductor 2, which consists of a plurality of metal wires 2 of highly conductive material and a high tensile element 3. The wires 2 are preferably copper wires. The high tensile element 3 is a loose composite of very thin but high tensile aramid fibers 4. A suitable material is sold under the trade name "Kevlar". This loose composite is soft and resilient in the radial direction, so that the element 3 is highly flexible. A layer of insulation 5, consisting of, for example, polyurethane, is provided around the conductor 1.

The conductor 1 has a large number of metal wires 2, which are combined with the high tensile element 3, the overall cross section of which is the same as that of one of the individual wires 2, to form the unit representing the conductor 1. This can be done in any desired way. Suitable methods are referred to as "twisting", "stranding", or "bunching". The conductor 1 should have an approximately circular cross section after production, before the insulation 5 is applied by means of, for example, an extruder.

The conductor 1 can have, for example, a total cross section of 0.5 $mm^2$. It can consist of 61 wires 2, each of which has a diameter of 0.1 mm. The element 3 consisting of aramid fibers 4 can also have a diameter of 0.1 mm.

The aramid fibers 4 of the high tensile element 4 can be coated with a moisture-repellent material for protection against the moisture which may intrude into the conductor 1. Such materials include resins and waxes, for example.

A line L according to the invention can consist of only one insulated conductor 1, as in the exemplary embodiment illustrated here. It is also possible, however, for the line to comprise two or more of these conductors, which are then advisably twisted together and surrounded by, for example, a common jacket of polyurethane.

The invention claimed is:

1. Flexible electric line comprising:

at least one electrical conductor, having a high tensile, nonmetallic element and a plurality of highly conductive metal wires arranged around it;

wherein said high tensile element is a loose composite of a large number of aramid fibers, said loose composite of a large number of aramid fibers being easily deformable when said at least one conductor is to be attached by crimping to contact parts;

wherein the cross section of said high tensile element is the same as that of one of the metallic wires; and said conductor surrounded by a layer of insulation.

2. The flexible electric line according to claim 1, wherein the aramid fibers are coated with a moisture-repellent material.

3. The flexible electric line according to claim 2, wherein the wires are made of copper.

4. The flexible electric line according to claim 2, wherein said moisture-repellent material is either one of resin and wax.

5. The flexible electric line according to claim 1, wherein the wires are made of copper.

* * * * *